US005634588A

United States Patent [19]

Jørgensen-Beck et al.

[11] Patent Number: 5,634,588

[45] Date of Patent: Jun. 3, 1997

[54] PIVOTING LID BOX

[75] Inventors: Frode Jørgensen-Beck; Heinrich W. Lambach, both of Horsens, Denmark

[73] Assignee: Schur Engineering A/S, Horsens, Denmark

[21] Appl. No.: 428,189

[22] PCT Filed: Nov. 4, 1993

[86] PCT No.: PCT/DK93/00359

§ 371 Date: Aug. 7, 1995

§ 102(e) Date: Aug. 7, 1995

[87] PCT Pub. No.: WO94/10048

PCT Pub. Date: May 11, 1994

[30] Foreign Application Priority Data

Nov. 5, 1992 [DK] Denmark ..... 1346/92

[51] Int. Cl.[6] ..... B65D 5/66

[52] U.S. Cl. ..... 229/148; 206/273; 229/160.1

[58] Field of Search ..... 229/145, 148, 229/160.1; 206/268, 273

[56] References Cited

U.S. PATENT DOCUMENTS

| | | | |
|---|---|---|---|
| 2,982,465 | 5/1961 | Fallert | 229/148 |
| 3,426,956 | 2/1969 | Frohlicher | 229/145 |
| 3,608,812 | 9/1971 | Hamilton | 229/145 |
| 3,963,173 | 6/1976 | Stone | 229/160.1 |
| 4,048,052 | 9/1977 | Tolaas | 229/145 |
| 4,083,455 | 4/1978 | Keating, Jr. | 229/145 |
| 4,284,197 | 8/1981 | Meyers | 229/145 |
| 4,948,038 | 8/1990 | Moeller | 229/160.1 |
| 5,443,202 | 8/1995 | Jorgensen-Beck et al. | 229/160.1 |

FOREIGN PATENT DOCUMENTS

| | | | |
|---|---|---|---|
| 2013269 | 10/1970 | Germany | 229/160.1 |
| 2306254 | 8/1973 | Germany | 229/160.1 |
| 585606 | 2/1947 | United Kingdom | 229/160.1 |
| 1119766 | 7/1968 | United Kingdom | 229/160.1 |

*Primary Examiner*—Gary E. Elkins

*Attorney, Agent, or Firm*—Antonelli, Terry, Stout & Kraus, LLP

[57] ABSTRACT

A box is disclosed having a pivot lid and a skirt. The skirt has an internal edge cooperating in a snap locking manner with a folded-over flap at the front edge area of the box mouth. This flap protrudes from an edge area which, as a whole, is resiliently depressible into the box, whereby a snap locking is achieved which will be substantially independent of the manufacturing tolerances of the box. The locking and, in particular, the release of the locking by the opening of the lid will take place in a manner that is very convenient for the user, because the spring action after the release of the locking will contribute to the opening of the lid.

5 Claims, 2 Drawing Sheets

PIVOTING LID BOX

BACKGROUND OF THE INVENTION

1. Field Of The Invention

The present invention relates to a carton box of the pastil box type and of the kind having a pivoting lid which, when closed, will engage with the associated box member in a snap locking manner. For pastil boxes for pocket use it can be a problem that a simple pivoting lid box can easily be opened unintentionally, and it should be ensured, therefore, that some locking function should occur, requiring a certain, modest and willful influencing on the lid for opening the lid.

2. Description of the Prior Art

There are already known different systems or designs for achieving a locking function, each with associated advantages and disadvantages, but the invention is directed to one of these systems, namely where the snap locking is established as an engagement between the outer edge of an exterior holding flap folded over from the front or top edge of the box body and an internally projecting locking edge on the front panel of the pivoting lid. When the pivoting lid is swung up about the upper, rear edge of the box the said locking edge will cause the bent over holding flap to be swung outwardly until it is swung out so far that it can no longer retain the lid against being swung up freely, and correspondingly the holding flap, when the lid is closed, will be brought into snap locking engagement with the locking edge at the inside of the front panel of the pivoting lid.

With this type of boxes it is possible to obtain a very efficient snap locking, but the same efficiency accounts for considerable problems in that even with small production tolerances rather large variations in the required opening force may be encountered. The boxes can be difficult to open.

Summary of the Invention

According to the invention it has been found that it is possible to remedy this drawback by a relatively modest modification, viz. by arranging for the front side edge portion, from which the holding flap projects, to be without any immediate folding or abutment connection with the adjacent side panels of the box, but to be free to yield resiliently inwardly all over its width, i.e. over the width of of the holding flap. This yielding or springing ability results in a considerably changed and for the user much more pleasant opening characteristic of the pivoting lid, which will not now be opened via a sharp or rigid closing edge, but via a resiliently yieldable closing edge that will oppose the initial opening, but thereafter promote the further opening, viz. by the returning of the resilient system. It is of major importance, however, that it is possible to absorb or tolerate relatively high tolerance deviations in the production of the boxes, since the user will hardly notice whether the discussed resiliency is somewhat more or less pronounced. Also, in a more important manner, the user can count on an effective snap locking of the closed pivoting lid without experiencing boxes, which, for the lid to be opened, should be subjected to no less than damaging force. Moreover, the user will feel a pleasant, springy co-opening force on the lid as soon as the locking engagement is released during the further opening of the pivot lid.

BRIEF DESCRIPTION OF THE DRAWINGS

In the following the invention is described in more detail with reference to the drawing, in which.

DESCRIPTION OF THE PREFERRED EMBODIMENTS

Figure 5:
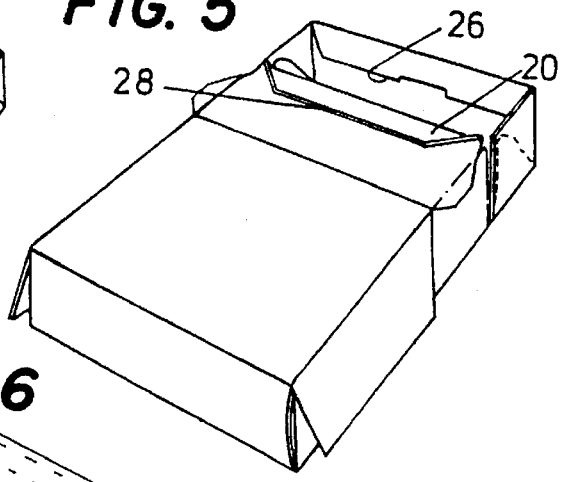
Figure 9:
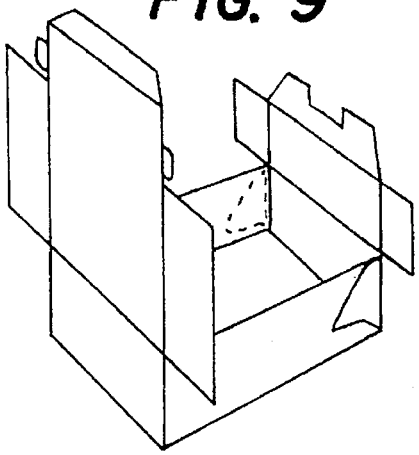
FIG. 9–15 illustrate other preferred embodiments of erecting a box in accordance with the present invention.

In use of the box according to the invention it will normally will assume a lying or substantially horizontal position as shown in FIG. 5, i.e. with the box front side facing upwardly. However to the extent it will be necessary to denote parts of the box with reference to the main directions of the space the reference position will be the one shown in FIGS. 8 and 9, i.e. with the box standing upright with its mouth located at the top.

Figure 1:
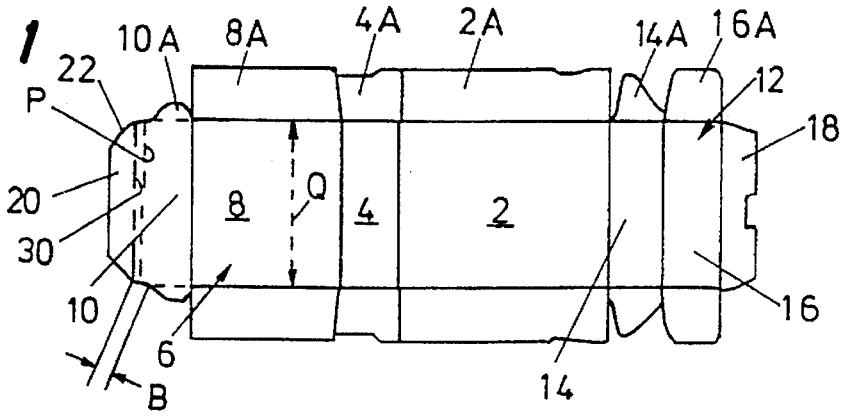
FIG. 1 is a plan view of a blank for a box according to the invention.

The box blank shown in FIG. 1 consists of a rear side panel 2, a bottom panel 4, and a front side panel 6 which is made up of a lower front panel portion 8 and an upper panel portion 10, while at the opposite end of the rear side panel there is provided a lid portion 12 comprising a top panel 14 hinged to the rear side panel 2 and a front lid panel 16 continuing in a fold-over flap 18. All of the panel portions except the latter flap 18 are provided, at the lateral sides of the blank, with outwardly projecting edge panels denoted by the respective reference numerals with the addition A. The upper front panel portion 10 is extended into a locking flap 20 having obliquely cut corners 22.

Figure 2:
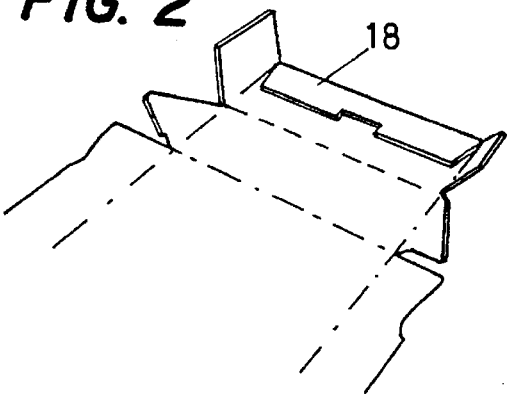
FIGS. 2 and 3 are perspective view illustrating the erection of one end portion thereof.
Figure 3:
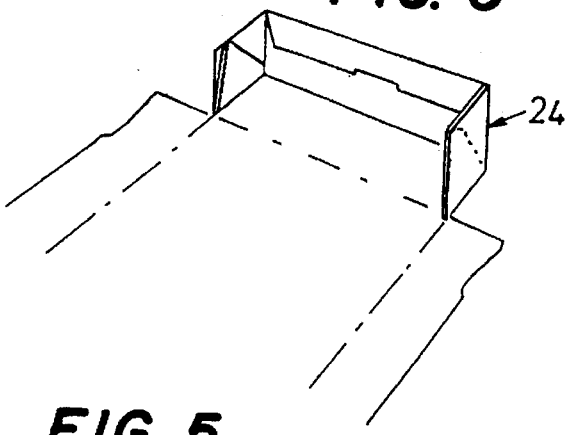

The blank is prepared for use by a folding over of the fold-over flap 18 and glueing it to the panel 16. The blank edge panels 14A and 16A are folded upwardly, as illustrated in FIG. 2, and with the panels 14A located inside the panels 16A the panel 16 is folded upwardly, as illustrated in FIG. 3, thus forming a pivoting skirt lid 24 which is conventionally stabilized by glueing together the side panels or flaps 14A,16A.

Figure 4:
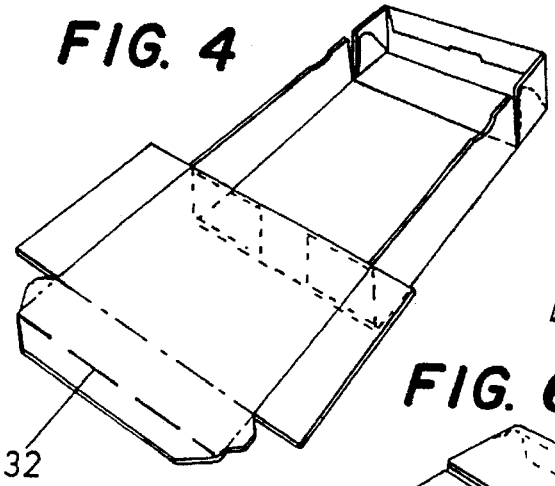
FIGS. 4–6 are corresponding view illustrating the erection of the remainder of a box.

Thereafter the bottom panel 4 is locally folded upwardly, as illustrated in FIG. 4, after the edge panels 4A having been folded inwardly. Hereby a pocket formed box member is prepared, ready for a rapid and safe filling through an open broad side. After the filling the front side panel 6 is folded forwardly over the filled pocket, and the side panels 8A and 10A are folded down and—at least as far as the panels 8A are concerned—are glued to the folded up side panels 2A, as illustrated in FIG. 5.

Prior to or in connection with the folding over of of the front side panel 6 the end flap 20 on the upper front side panel 10 is caused to be folded over, such that this flap 20 as shown in FIG. 5 will be folded over at the outer side of the panel 10, without being glued thereto, i.e. in its free condition the folded-over flap 20 will be slightly protruding from the panel 10. The edge flaps 10A, which are folded down together with the side panels 8A, may correspondingly be left slightly projecting from the side panels 2A of the rear panel 2, if they are not fixed thereto by glueing.

Figure 6:
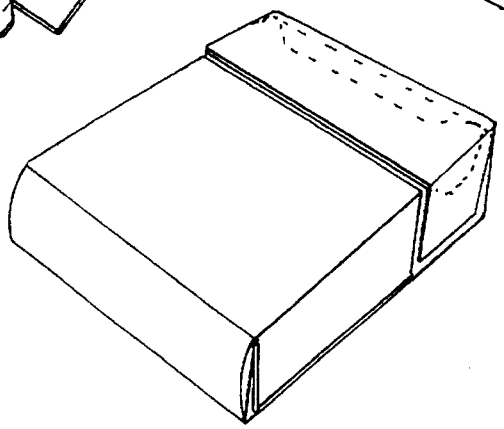

Thereafter the pivoting lid 24 is caused to be closed as illustrated in, FIG. 6. By this closing, according to FIG. 7, the free edge, 26, of the fold-over flap 18 on the lid will snap under the free edge, 28, of the freely bent-over end flap 20 at the upper front edge of the box, so as to hereby establish a kind of snap locking engagement. The ready made box may then be packed in an outer casing, e.g. a tearable wrapping of cellophane.

Figures 7, 8:
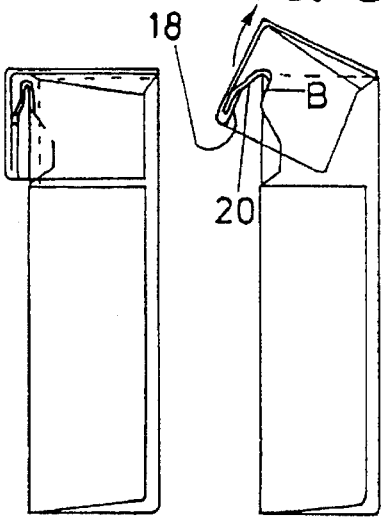
FIGS. 7–8 are lateral view, partly in section, illustrating the opening and closing movement of the the pivot lid.

When the box is to be opened, as illustrated in FIG. 8, what happens is that the interior edge 26 in the lid 24 will be forced upwardly against the free edge of the fold-over flap 18, whereby an entirely free opening will be effectively resisted. However, by a forceful opening influence on the lid it will be possible to cause a lid opening, a illustrated in FIG. 8, in causing an outwardly directed pivoting of the flap 20 until the latter will no longer be hindering for a further, free opening of the lid into the position of use shown in FIG. 5. In this position the user can shake or pour out pastils to be collected through the opening produced by the opening of the lid.

What is different about the embodiment of the invention is that the side flaps 10A are designed in a special way, viz. in projecting from the panel 10 at a certain, small distance, B, from the folding line designated 30 in FIG. 1 between the panels 10 and 20, in conjunction with the width of the outer end of the panel 10 as marked by an arrow P held slightly smaller than the distance otherwise occurring between the side folding lines of the box blank, as illustrated by arrow Q in FIG. 1, including the folding lines of the edge flaps 10A.

Thus, the front panel 10 may well be supported generally inwardly against the edges of the folded up side panels 2A, but not along the topmost stretch B, and for this reason the basis of the flap 20 is able to be pressed resiliently inwardly. With a certain exaggeration this is illustrated in FIG., 8, where the lid is about to be opened. By that opening the flap 20 is forced outwardly by its engagement with the panel edge 26, and the flap 20 will be swung upwardly until it is brought to pass over its rest position. When this happens, the resiliently depressed portion B may then straighten itself out, an by this straightening out the free edge of the flap 20 will now act in co-opening on the lid, inasfar as the influence will occur up at the plane of connection between the basis of the flap 20, i.e. the upper front edge of the box, and the rear hinge line of the lid. Thereafter, the lid will be free to be opened.

By the opening the flap 20 will be swung out rather widely, and according to FIG. 5 it will be left in a noticeably swung-out position. This, however, will be without any functual significance, as it will automatically be swung inwardly again, when the lid is closed into the closed and locked position shown in FIG. 7.

It will be appreciated that the lid will be suitably blocked against being opened freely and that the blocking is yieldable in such a manner that it will not be decisively affected by small tolerance deviations, which would otherwise reveal themselves strongly by the relevant small dimensions. By the opening the blocking is released in a manner which, for the user, is found pleasantly soft, and the co-operation of the box itself in the further opening right after the release is experienced is user friendly. The parts do not tend to become damaged by the number of openings that will occur for boxes of this type.

Figure 10:
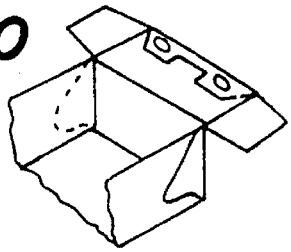
Figure 11:
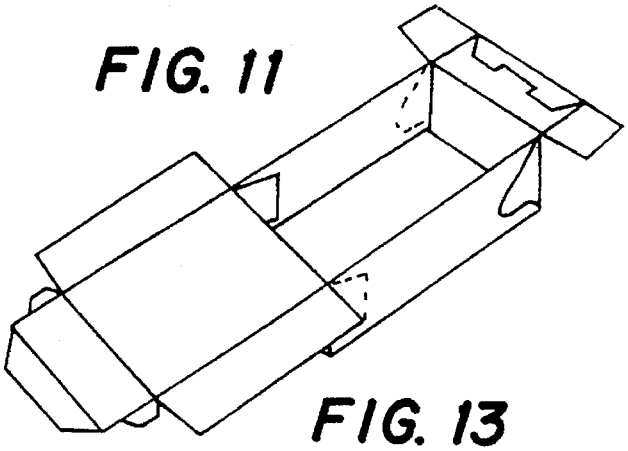
Figure 12:
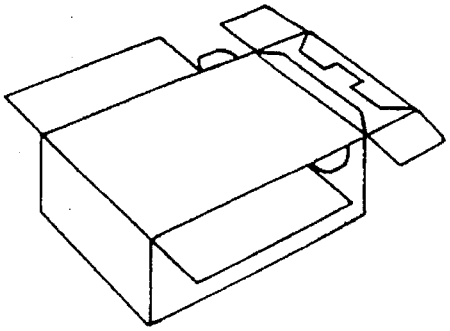

FIGS. 9–13 illustrate another and in practice preferred method of erecting the box. Initially, according to FIG. 9, the panel portions projecting from the ends of the rear side panel 2 are folded upwardly, with the flaps 14A folded inwardly outside of the side panels 2A. Thereafter, as illustrated in FIG. 10, the lid front panel 16 is folded down, the fold-over flap 18, folded over and fastened to the panel 16. Correspondingly, the front side panel 8 is folded down to horizontal as shown in FIG. 11, where the box member is ready for filling.

Figure 13:
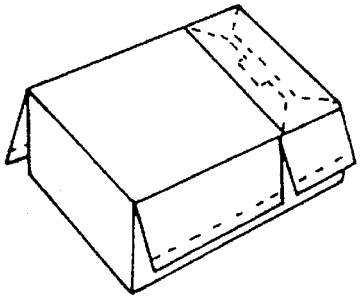

After the filling the front side panel 8 is folded forwardly so as to close the box, so that the flap 20 will project over the lid panel 16. Thereafter, as illustrated in FIG.13, this panel 16 is folded back over the box, whereby also the flap 20 will be folded over, while the edge flaps 16A are laid onto the projecting edge tags 10A. Finally, the side panels 8A and 16A are folded down and fastened to the box sides, whereby also the edge tags 10A will be folded down.

Figure 14:
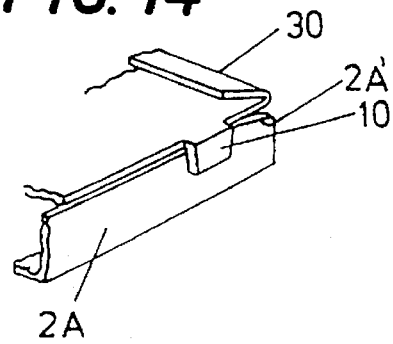
Figure 15:
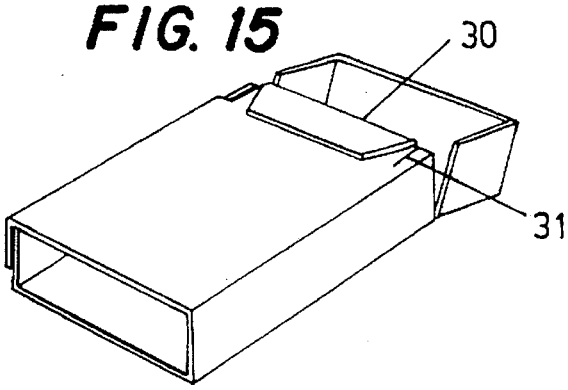

It is not essential for the invention that the box be designed in just the manner shown, when only care is taken that the basis of the locking flap 20 is somewhat resiliently depressable. Thus, as shown in FIG. 14 it is a possibility that the the edge part 30 extends all over the width of the box, while the upper edge of the side panel 2A located therebehind is cut off obliquely as shown at 2A. In a side folded box as shown in FIG. 15 the entire front panel will be coherent with one of the side panels of the box, whereby the system described above will only be present at one side, viz. the opposite side. In or at the folding connection between the front panel and the side panel an uppermost, short cutting line 31 or a recess should be provided for forming the free length B of the basis of the closing flap.

The fold-over line 30 of the closing flap 20 may be partly through-cut, preferably by way of oblong, narrow slots 32 as indicated in FIG. 4, whereby the flap is easier to hold folded-over. Optionally, the folding line 30 may be located slightly spaced below the mouthing of the box, and it may extend over only a part of the width of the box.

We claim:

1. A box comprising:

a mouth having a mouth edge and an externally folded over holding flap having a flap edge;

a pivoting lid having a projecting locking edge;

a holding flap projecting from an edge area which is resiliently depressible into the box;

a front side having a panel;

side panels having edges folded into abutment with the front side panel;

a rear panel from which the side panels project; and wherein the front side panel at an area adjacent the edge of the mouth has a reduced width for permitting depressing of the holding flap without contact of the edges of the side panels; and the flap edge engages the projecting locking edge at an inner side of the pivoting lid.

2. A box in accordance with claim 1 wherein:

the front side panel is supported offset from the mouth edge on the side panel edges with outwardly projecting side flaps bending over the side panel edges.

3. A box comprising:

a mouth having a mouth edge and an externally folded over holding flap having a flap edge;

a pivoting lid having a projecting locking edge;

a holding flap projecting from an edge area which is resiliently depressible into the box;

a front side having a panel;

side panels having edges folded into abutment with the front side panel;

a rear panel from which the side panels project; and wherein the side panels adjacent the mouth have a decreasing height with an area adjacent a top of the front side panel bending inwardly resiliently; and the flap edge engages the projecting locking edge at an inner side of the privoting lid.

4. A box in accordance with claim 3 wherein:

the front side panel is supported offset from the mouth edge on the side panel edges with outwardly projecting side flaps bending over the side panel edges.

5. A box comprising:

a mouth having a mouth edge and an externally folded over holding flap having a flap edge;

a pivoting lid having a projecting locking edge;

a holding flap projecting from an edge area which is resiliently depressible into the box;

a front side having a panel;

side panels having edges folded into abutment with the front side panel;

a rear panel from which the side panels project; and cuts extending from the mouth edge outside of the holding flap along a portion of the box; and wherein the flap edge engages the projecting locking edge at an inner side of the pivoting lid.

* * * * *